United States Patent [19]

Vallor

[11] 4,289,543

[45] Sep. 15, 1981

[54] METHOD FOR PRE-CONDITIONING A WAREWASHER

[75] Inventor: Ben J. Vallor, Troy, Ohio

[73] Assignee: Hobart Corporation, Troy, Ohio

[21] Appl. No.: 65,305

[22] Filed: Aug. 9, 1979

[51] Int. Cl.[3] ..... B08B 30/00

[52] U.S. Cl. ..... 134/25.2; 134/29

[58] Field of Search ..... 134/10, 29, 25.4, 105, 134/108, 58 D, 57 D, 95, 72

[56] References Cited

U.S. PATENT DOCUMENTS

| | | | |
|---|---|---|---|
| 3,064,662 | 11/1962 | Given et al. | 134/108 |
| 3,083,717 | 4/1963 | Bear | 131/108 |
| 3,149,637 | 9/1964 | Claywell | 134/108 |
| 3,194,250 | 7/1965 | Delapena | 134/108 |
| 3,440,399 | 4/1969 | Reifenberg | 134/108 |
| 3,451,400 | 6/1969 | Cushing | 134/58 D |

*Primary Examiner*—S. Leon Bashore
*Assistant Examiner*—Michael L. Goldman
*Attorney, Agent, or Firm*—Biebel, French & Nauman

[57] ABSTRACT

Water is first introduced into a warewasher in a static fill, statically heated to an effective washing temperature, and then circulated and sprayed onto the food ware items to precondition them and the warewasher for effective soil removal.

2 Claims, 4 Drawing Figures

FIG-1

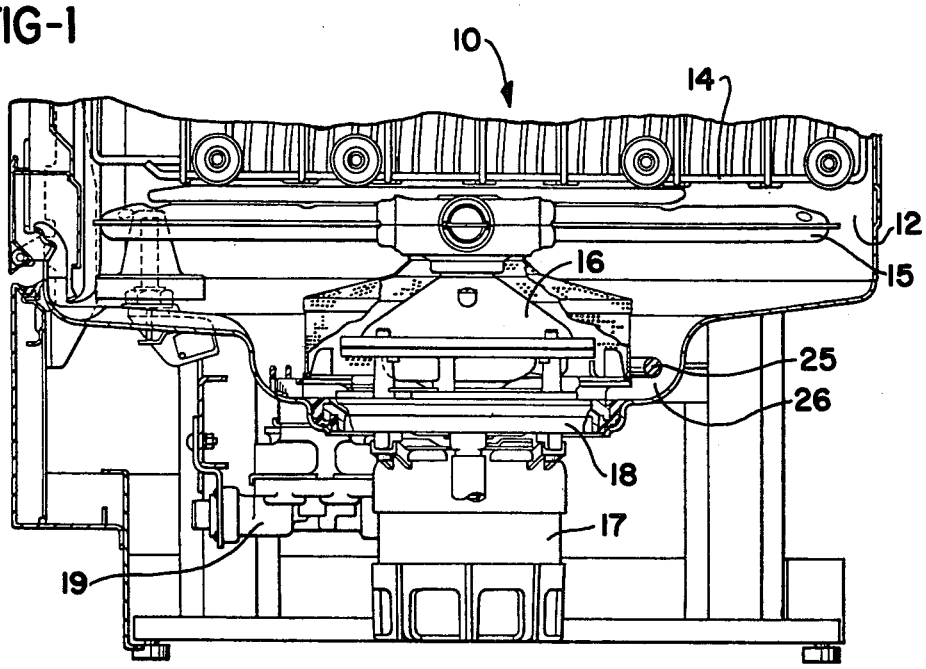

FIG-4

NORMAL CYCLE

| | |
|---|---|
| STATIC FILL & HEAT / PRERINSE | PUMP OFF |
| | FILL 7 QT. |
| | HEAT ON (1400 WATTS) |
| | HEAT TO 150° F. |
| | HEAT OFF |
| | PUMP ON |
| | WASH 1 MIN. 30 SEC. |
| | DRAIN 1 MIN. 30 SEC. |
| WASH & RINSE | FILL 9 QT. |
| | WASH 4 MIN. 30 SEC. & HEAT (700 WATT) USES DETERGENT AFT. 40 SEC. |
| | HEAT OFF |
| | DRAIN 1 MIN. 30 SEC. |
| | FILL 7 QT. |
| | RINSE 1 MIN 50 SEC. |
| | DRAIN 1 MIN. 30 SEC. |
| | FILL 9 QT. |
| | WASH 9 MIN. & HEAT (700 WATT) USES DETERGENT AFTER 2 MIN. |
| | HEAT OFF |
| | DRAIN 1 MIN. 30 SEC. |
| RINSE | FILL 7 QT. |
| | RINSE 3 MIN. 20 SEC. |
| | DRAIN 1 MIN. 30 SEC. |
| | PUMP OFF |
| | FILL 9 QT. |
| | HEAT ON (1400 WATT) |
| | HEAT TO 150° F. |
| | HEAT OFF |
| | PUMP ON |
| | RINSE 4 MIN. 30 SEC. |
| | DRAIN 1 MIN. 30 SEC. |
| SCAVANGE DRAIN | PUMP OFF 1 MIN. 30 SEC. |
| | PUMP ON 1 MIN. 30 SEC. |
| | PUMP OFF |
| DRY | BLOWER ON 3 MIN. |
| | BLOWER OFF 1 MIN. 30 SEC. |
| | BLOWER ON 3 MIN. |
| | BLOWER OFF 1 MIN. 30 SEC. |
| | BLOWER ON 3 MIN. |
| | BLOWER OFF 1 MIN. 30 SEC. |
| | BLOWER ON 24 MIN. |

METHOD FOR PRE-CONDITIONING A WAREWASHER

BACKGROUND OF THE INVENTION

This invention relates to warewashers and more particularly to a method for achieving satisfactory washing results where the available water supply is not hot enough. The invention has particular application in domestic dishwashing machines.

It is common in the United States for manufacturers to specify that the water supply temperature for a warewasher must be at least 140° F. at the machine. In some domestic applications the central hot water tank is set above 140° F., but is located a long distance from the dishwashing machine, so that the water loses heat during transmission from the hot water tank. In other cases the hot water heater is set below 140° F. The latter is understandable since, for almost every other domestic application, water at 120° F. is satisfactory.

In the past, if washing results in a domestic dishwashing machine were not satisfactory, one could simply increase the temperature of the hot water heater. With today's increasing energy costs and greater emphasis upon energy conservation, such a remedy is no longer expedient. In fact, even where there are no substantial heat losses, it is increasingly difficult to justify raising the hot water supply temperature for the entire household merely to meet the needs of the dishwashing machine.

Nevertheless, for satisfactory results it is currently necessary to have a temperature within the machine of 130° F. -140° F. When water temperatures fall much below that range, certain foodstuffs, for example fats, may not be properly removed. Common dishwashing detergents also quickly lose their effectiveness as temperatures fall. At temperatures below 105° F. -110° F. the detergents and food proteins cause sudsing which seriously impairs the effectiveness of the recirculating and spraying system within the dishwashing machine.

Of course, there are low temperature detergent formulations which are reasonably effective at reduced temperatures. However, such detergents are expensive and are not widely available at present. Therefore, the need which now exists is for a domestic dishwashing machine which is at once compatible with current domestic dishwashing practices and which will at the same time provide satisfactory washability with water supplied at reduced temperatures.

The obvious answer is to add heat to the water within or just before reaching the dishwashing machine to bring the water temperature up to an acceptable level. Dishwashing machines with a sump heater have in fact been known and available for many years. For example, U.S. Pat. No. 3,707,156, assigned to the assignee of the present invention, shows a domestic dishwashing machine in which a first water heating element is energized during washing periods to maintain the wash water temperature against ordinary losses to the outside, and a second heating element may be energized during a final rinse period, at the user's option, to raise the water temperature to a higher level for more effective sanitizing of the ware prior to drying.

U.S. Pat. Nos. 4,159,211, 4,070,204 and 3,440,399 provide examples of domestic dishwashing machines designed to compensate for an inadequate water supply temperature. These machines have thermostatically controlled heaters for adding heat as long as the water temperature is below a predetermined level. Further, the '211 and '399 devices interrupt operation of the timer motor during certain portions of the cycle to prevent the cycle from progressing further until the predetermined temperature is reached. Unfortunately, this can result in unacceptably prolonged washing cycles.

A domestic dishwashing machine, as a practical matter, cannot be designed to draw "unlimited" amounts of power. This is not because such a machine might be uneconomical to operate, but because in many homes the maximum electrical service available is only 15 or 20 amps. Therefore, if the recirculating motor draws 600–700 watts, the water heater must be limited to about 700 watts if it is to be operated simultaneously with the motor. Subtracting heat losses to the ambient during recirculation of the water within the machine, the net temperature rise during 700 watt heating is very slow. Further, the overall power consumption during this time is nearly twice as great (due to the motor), so that a prolonged heating cycle can actually become very expensive. Even worse, the suspended food soil debris can be pulverized and disintegrated to such an extent that large quantities of it will no longer be stopped by the fine filter in the recirculating system. This can seriously increase the amount of food soil debris which is subsequently redeposited onto the food ware items within the dishwashing machine.

A need thus remains for a domestic dishwashing machine which will provide excellent washability with reduced supply water temperatures, in acceptable cycle time periods, and without excessive energy consumption. One solution, for example, might be to spray the food ware items with the supply water while it is being admitted, as is commonly done in many machines, to pre-rinse them by removing the loose soil therefrom, and to warm them with whatever heat is available from the supply water. Then, to prepare for a wash cycle following this pre-rinse, the operation of the pump could be suspended and increased heat turned on to warm the water to approximately 150° F. The pump could then be briefly operated to transfer this heat to the food ware items, following which the water would be drained and the succeeding wash cycle commenced. Unfortunately, although this might seem a logical way to go, it was discovered that the washability results are actually worse. Spotting, filming, and baked-on soil redeposition were unacceptable. In fact, additional final rinses had to be added to get adequate spotting and filming results, and even these were not satisfactory under certain field conditions. The above-noted needs for a domestic dishwashing machine, therefore, still remain.

SUMMARY OF THE INVENTION

Briefly, the present invention meets the above needs and purposes by initially introducing water from the water supply in a static fill and then statically heating the water to at least the pre-determined effective washing temperature of the warewashing chemicals to be used therein. Thus, when conventional and commonly used chemicals requiring temperatures in the range of 130° F. -140° F. are to be used, the static introduction and heating of the water is to a predetermined temperature of 140°-150° F. (150° F. in the preferred embodiment). The term "static" means that recirculating pump is not operating during that time. As discussed above, this makes a much greater heating rate possible (e.g. 1,400 watts), so that the water in the sump can be more quickly raised to the desired temperature.

The static fill and heating are the first steps in a sequence which pre-conditions the warewasher and its contents for effective washing. Once the water has been statically heated to the predetermined temperature, only then is it recirculated and sprayed onto the food ware items to remove the loose food soil therefrom and simultaneously warm them with the heated water. The recirculation is continued for only a short duration —long enough to remove the loose soil but short enough to avoid substantial foaming or disintegration. Typically the recirculating and spraying during preconditioning will last about one and one-half minutes, following which the water and suspended food soil are drained from the dishwashing machine.

The dishwashing machine and food ware items are now pre-conditioned for washing, having had a considerable amount of the loose food soil removed and having been warmed to an efficient soil removal temperature. Now, when the next quantity of water is filled into the dishwashing machine, if it is, for example, at only 120° F. (for the reasons earlier discussed) the temperature of the water will not be further reduced by the food ware items, and the ordinary addition of heat from the standard 700 watt heater will be sufficient to maintain proper washing action while the recirculating pump is also operating. Since the pre-conditioning sequence is actually a pre-rinsing cycle, a detergent is not added at that time.

Once the dishwashing machine and food ware items have been pre-conditioned, the normal washing and rinsing operations may take place. Thus, the washing step which follows the pre-conditioning sequence introduces the water from the water supply in a dynamic fill in which the water is recirculated and sprayed onto the food ware items as it is being introduced. Warewashing chemicals, such as detergents, and maintenance heat (e.g. 700 watts) are also normally added to the water as it is recirculated and sprayed onto the preconditioned food ware items within the dishwashing machine. (Under certain soil conditions no detergent is added during the initial prewash fill during the normal wash cycle.)

As suggested above, the pre-conditioning sequence provides substantially improved washability without significantly increasing the total cycle time or consuming excessive energy. The results are remarkably better than in trials in which the continuous pump operation during a conventional dynamic fill was interrupted at some point, full heat added, and pump operation then continued.

The improvement is not only substantial and quite unexpected, but is not even fully understood. One theory which resulted from the present invention is that the high heat density in the immediate vicinity of the heating element during static heating may create a zone, or "corona", around the immersed heating element in which temperatures are great enough to adversely modify food soil and/or warewashing chemicals contained in the water. If such is the case, then the static fill and heating avoids this problem by heating the water before it contains these materials. In any event, the pre-conditioning sequence of the present invention yields substantially improved overall results and efficiency as compared with prior art warewashers having provisions for compensating for below normal water supply temperatures.

It is therefore an object of the present invention to provide an improved method for pre-conditioning a warewasher; a method particularly suited for use in a warewasher which receives water at a temperature below the effective washing temperature of the warewashing chemicals used therein; in which the water is first statically introduced and heated to the effective washing temperature, and then recirculated and sprayed onto the food ware items to remove soil therefrom and simultaneously warm them and the warewasher, to precondition them for effective soil removal; and to accomplish the above objects and purposes in a manner compatible for use with the widest variety of warewashers, and particularly suitable for use in domestic dishwashing machines, improving their washability with acceptably short cycle times.

Other objects and advantages of the invention will be apparent from the following description, the accompanying drawings and the appended claims.

BRIEF DESCRIPTION OF THE DRAWINGS

FIG. 1 is a partially broken away cross-sectional view of a portion of a domestic dishwashing machine provided with the method of the present invention;

FIG. 4 is another timer chart for the normal wash cycle portion of the FIG. 3 timer chart.

Figure 2:
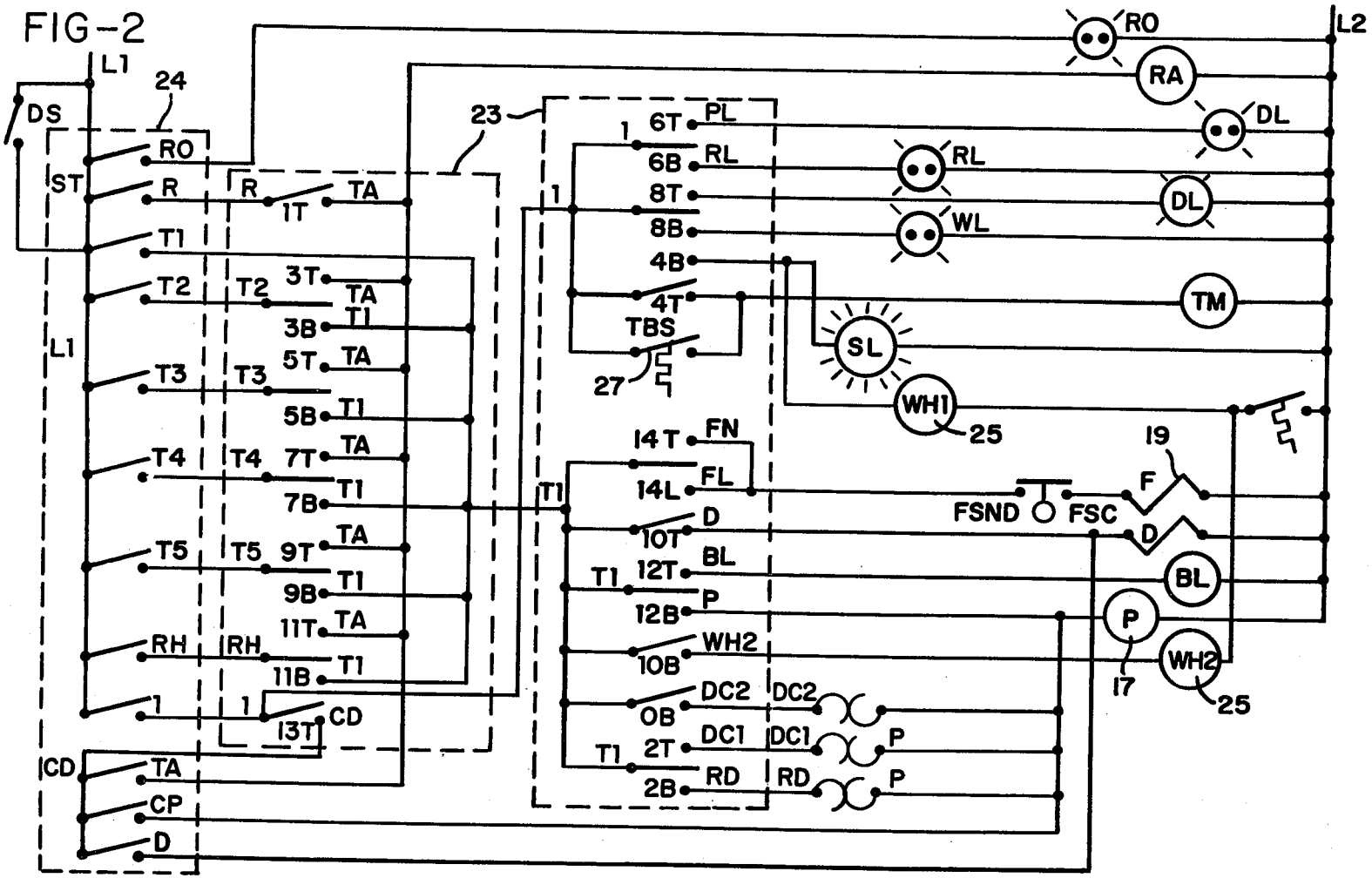
FIG. 2 is a wiring diagram for the machine shown in FIG. 1.

DESCRIPTION OF THE PREFERRED EMBODIMENT the dishwashing machine 10 shown in FIG. 1 includes a chamber 12 in which one or more racks 14 support food ware items (not shown) for washing by spraying water onto the food ware items from spray arms 15. The water is supplied to the spray arms 15 by a recirculating pump 16 which is driven by a motor 17. These items, as well as a drain pump 18 and fill valve 19, are conventional in domestic dishwashing machines.

A cycle control mechanism, such as a timer, of generally conventional overall configuration (not shown) controls timer switches 23 (FIG. 2) to operate the dishwashing machine in any one of several cycles selected by program switches 24. The actual timer operational sequences for the various cycles are shown in the FIG. 3 timing chart.

Figure 3:
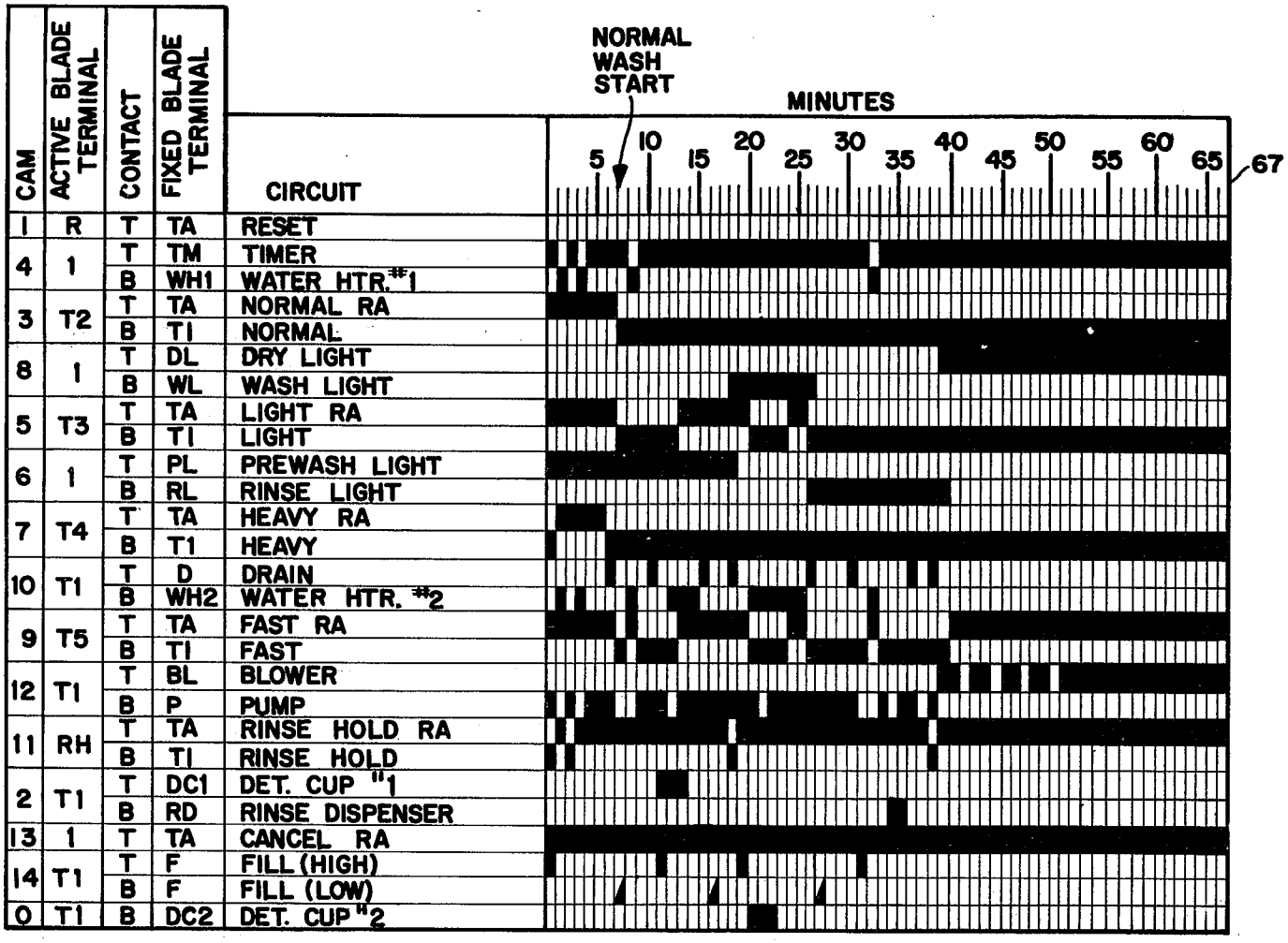
FIG. 3 is a timer chart for the cycles of the Fig. 1 machine.

For more ready interpretation of the FIG. 2 schematic and FIG. 3 timing chart, FIG. 4 uses a different format to present a timing chart for a normal wash cycle. This cycle starts at the point labelled "Normal Wash Start" in FIG. 3. It is selected by closing contact T2 in the program switches 24, causing the timer to advance rapidly to the Normal Wash Start, and then to slow to normal speed for controlling the operation of the dishwashing machine for the balance of the cycle.

As shown in FIG. 4, a pre-rinse, incorporating the pre-conditioning sequence of the present invention, starts the normal wash cycle. The fill valve 19 is opened to introduce seven quarts of water into the dishwashing machine chamber 12. During this time the motor 17 and recirculating pump 16 are turned off. A water heater 25 of conventional, semi-circular configuration is located in a sump 26 at the bottom of wash chamber 12. Heater 25 contains two 700 watt heating elements, WH1 and WH2, both of which are energized during the static fill and heat sequence (FIG. 4) to deliver 1400 watts of heat to the water in the dishwashing machine sump. A thermostatic switch 27 (FIG. 2) is connected to open the circuit of the timer motor TM (FIG. 2) at this time so that the timer motor is turned off while the heating of the water takes place. Upon reaching the preset temperature of the thermostatic switch, for example 150 ° F., switch 27 restores power to the timer motor. The timer then advances, as shown in the timing charts, to discontinue power to the water heater elements WH1 and WH2 and operate motor 17 to recirculate the water in a short, detergent-free pre-rinse. This pre-rinse lasts approximately ninety seconds, and then the water is drained from chamber 12, leaving the food ware items and wash chamber preconditioned for effective soil removal.

Next follows a wash cycle including three fills, the middle one of which is a rinse, and the other two of which are recirculating washes in which detergent is normally added and water heater element WH2 is energized to add 700 watts of heat to the water in the dishwashing machine. The wash cycle is followed by two rinses, which, in turn, are followed by a drying cycle.

As may be seen, therefore, the present invention has numerous advantages. Principally, it assures that an effective washing temperature will be available in the washing machine chamber regardless of the fact that the water supply temperature is below effective washing temperature. Therefore, in addition to compensating for already inadequate supply temperatures existing in many households, it opens the way to substantial energy savings by making it possible and practical actually to reduce the hot water heater temperature in many homes. By reducing the hot water heater temperature, a net overall energy savings will be realized for the household. Yet this can be done with no loss in the effectiveness and performance of the dishwashing machine. The present invention provides these advantages by actually pre-conditioning the warewasher and its contents by statically filling and heating the first water introduced therein prior to any recirculating, spraying and washing action.

While the method herein described constitutes a preferred embodiment of the invention, it is to be understood that the inventionis not limited to this precise method, and that changes may be made without departing from the scope of the invention.

What is claimed is:

1. A method for preconditioning a warewasher of the type in which food ware items are placed in a wash chamber and water is periodically supplied from a water supply at a temperature below the effective warewashing temperature by recirculating the water collected in a lower portion of the chamber and spraying it under pressure onto the food ware items, and the water flows by gravity from the food ware items back to the lower portion, comprising the steps of:

(a) first introducing a predetermined quantity of water from the water supply into the wash chamber of the warewasher, (b) next statically heating the water electrically in the lower portion of the wash chamber to a temperature in the range of 140° F. to 150° F., (c) then, after static heating is completed, without the use of warewashing chemicals, for the first time recirculating and spraying the heated water in the wash chamber onto the food ware items for a duration sufficient to remove food soil therefrom without causing substantial foaming or disintegration of the food soil in the wash chamber as it is recirculated, and to simultaneously warm the food ware and the wash chamber to a sufficient temperature such that supply water subsequently added will not be further reduced in temperature by the food ware items, and the subsequent addition of heat in an amount less than in the static heating step will be sufficient to maintain proper washing action during subsequent recirculation for effective soil removal during a subsequent washing operation, (d) draining the water and removed food soil from the wash chamber after said recirculating and spraying, (e) subsequently introducing water from the water supply into the wash chamber of the warewasher in a dynamic fill in which the water is simultaneously recirculated and sprayed onto the food ware items therein, (f) adding warewashing chemicals to the subsequently added water in the wash chamber as it is recirculated and sprayed therein onto the preconditioned food ware items within the wash chamber of the warewasher, and (g) simultaneously adding heat to the subsequently added water in the wash chamber at a rate sufficient to raise the water temperature to and maintain the water temperature at an effective warewashing temperature during washing, but at a rate lower than in the static heating step.

2. The method of claim 6 wherein said step of recirculating and spraying heated water for the first time has a duration of about one and one half minutes.

* * * * *